US005611990A

United States Patent [19]

Langlitz et al.

[11] Patent Number: 5,611,990

[45] Date of Patent: Mar. 18, 1997

[54] COOLED CONVERTER TRUNNION RING

[75] Inventors: Karlheinz Langlitz, Mülheim; Gunter Schmitz, Duisburg, both of Germany

[73] Assignee: Mannesmann Aktiengesellschaft, Dusseldorf, Germany

[21] Appl. No.: 492,849

[22] Filed: Jun. 20, 1995

[30] Foreign Application Priority Data

Jun. 20, 1994 [DE] Germany ..... 44 23 334.5

[51] Int. Cl.[6] ..... C21C 5/42

[52] U.S. Cl. ..... 266/241; 266/246

[58] Field of Search ..... 266/241, 246, 266/245, 247

[56] References Cited

U.S. PATENT DOCUMENTS 3,163,695 12/1964 Bumberger ..... 266/241
3,963,223 6/1976 Eysn ..... 266/241

FOREIGN PATENT DOCUMENTS 338307 8/1966 Germany .
3927928 2/1991 Germany .

*Primary Examiner*—Scott Kastler
*Attorney, Agent, or Firm*—Cohen, Pontani, Lieberman, Pavane

[57] ABSTRACT

A cooled converter trunnion ring, which is arranged at a distance from the converter, encompasses the converter and is connected to a coolant supply station. In order to achieve good accessibility of the trunnion ring by simple measures and to ensure reliable cooling of the loaded trunnion ring areas with low energy expenditure, a pipe coil, which runs in a largely meandering fashion and through which a liquid coolant flows, is provided on the inner surface of the inner side member substantially facing the converter of the steel mantle of the converter trunnion ring.

9 Claims, 3 Drawing Sheets

Fig. 3
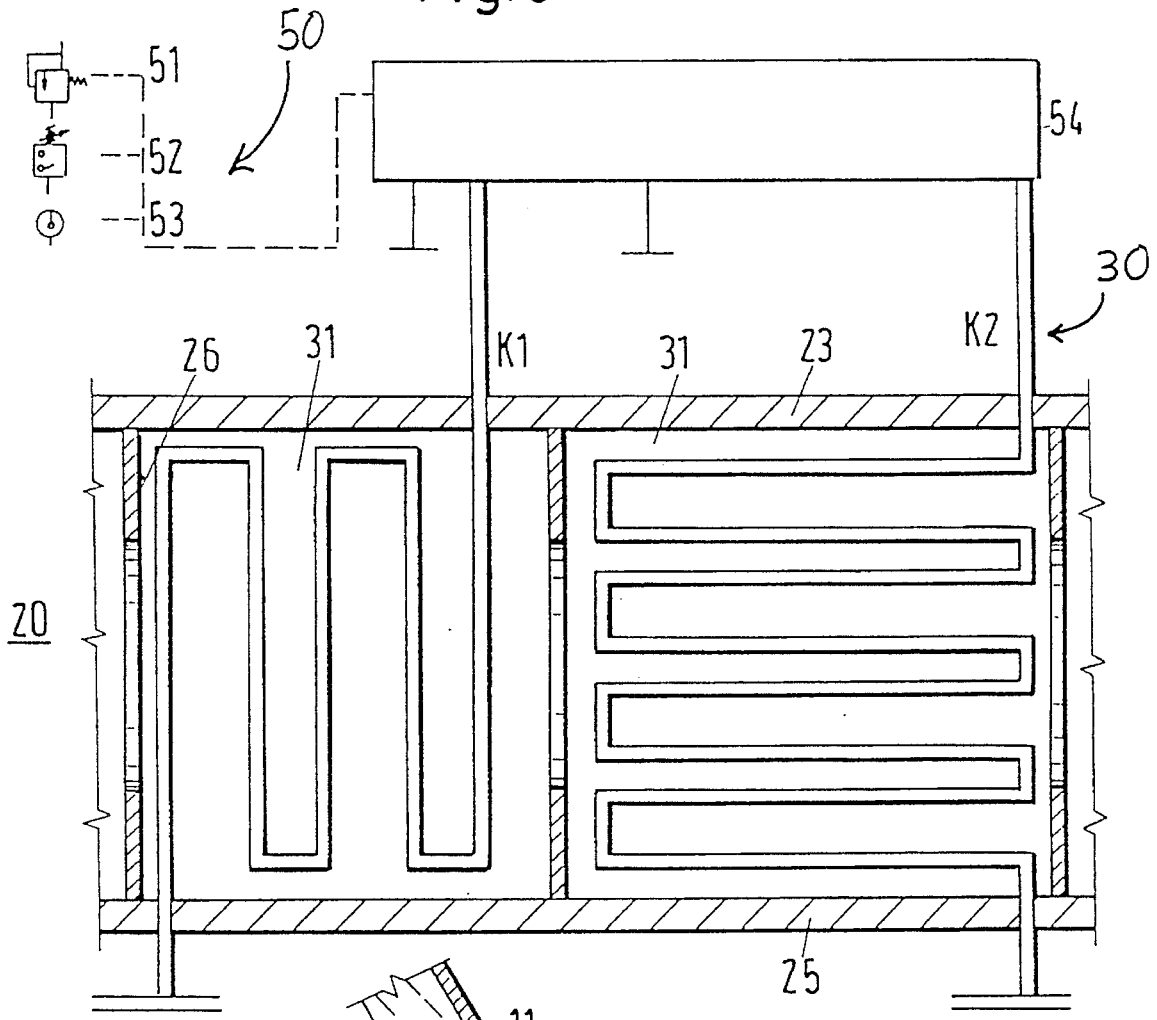
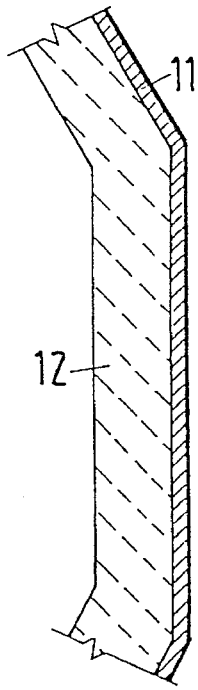
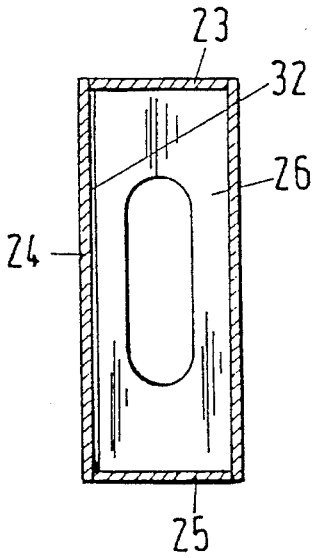
Fig. 4

COOLED CONVERTER TRUNNION RING

BACKGROUND OF THE INVENTION

1. Field of the Invention

The invention relates to a cooled trunnion ring for a converter, and more particularly to a trunnion ring that is arranged at a distance from the converter, encompasses the converter and is connected to a coolant supply station.

2. Description of the Prior Art

Converters used in steel production, when of a certain size or larger, are located in non-attached trunnion rings. When an increased demand is placed on converter vessel capacity, especially when refractory linings with high carbon content are used, the thermal load of the converter wall, like that of the trunnion ring, becomes ever greater. This thermal load also effects the trunnion ring arranged at a distance of approximately 100 to 200 mm from the converter.

In order to prevent the permissible limits for the vessel mantle from being exceeded and, at the same time, to reduce the thermal load of the converter trunnion ring, a cooling medium is customarily conducted in the space between the ring and the vessel mantle. Thus, an air cooling system for heatable metallurgical vessels equipped with non-attached trunnion rings is known from DE 39 27 928 A1. In this system, air ducts are arranged on the outer side of the trunnion ring, via which cooling air is conducted between the trunnion ring and the outer wall of the metallurgical vessel. The disadvantage of this air cooling system is that gaseous media have only a low capacity for extracting heat. Additionally, the air in this system is blown off, which is undesirable for environmental reasons.

It is also known to completely fill the trunnion ring with water for cooling purposes. Disadvantageously, the water supplied and extracted through the trunnion increases the weight of the trunnion ring. Furthermore, in the event of certain malfunctions, for example, a vessel break-out, the trunnion ring may also suffer damage, resulting in a dangerous convergence below the converter of liquid melt and uncontrollable quantities of water. Moreover, when high thermal loads are placed on the trunnion ring mantle, especially given the low flow speed of the cooling water, blistering occurs on the inner wall (the so-called "killing frost effect"). The negative consequence of this is that heat extraction is prevented at these locations.

In addition, filling the interior of the converter trunnion ring with water makes it inaccessible for the purpose of inspection and maintenance.

SUMMARY OF THE INVENTION

Accordingly, it is an object of the present invention to provide a cooling system for a converter trunnion ring which, via simple means, permits the trunnion ring to be freely accessible and ensures reliable cooling of the loaded trunnion ring areas at a low expenditure of energy. Pursuant to this object, and others which will become apparent hereafter, one aspect of the present invention resides in a cooled converter trunnion ring that can be arranged at a distance from the converter and encompasses the converter. The trunnion ring is comprised of a steel mantle having an inner side that faces the converter, which inner side has an inner surface to which a pipe coil is mounted in a meandering fashion. A liquid coolant flows through the pipe coil to provide cooling.

According to the invention, a tubular coolant conduit, which runs in a largely meandering fashion, is provided on the mantle of the converter trunnion ring. Portions of the coolant conduit—for example, at openings through the transverse metal sheet—may be formed by pipes that run parallel to one another. Cooling water is conducted through this pipe coil in a relatively low quantity but at relatively high speed. The pipe coil is arranged in such a manner that the individual parallel sections of pipe are spaced at a distance from one another equal to at least twice their diameter (in reference to the center line), so that broad portions of the trunnion ring mantle are cooled by a single cooling line, starting from the cooling line and moving outward, without coming into contact with the coolant. The advantage here is that the required quantity of coolant is reduced while the flow speed is increased. In addition, areas are left free to allow inspection of the trunnion ring mantle, e.g., for cracks, etc. Moveover, during extreme emergencies, e.g., in the event of local destruction of the trunnion ring, the coolant supply can be shut off within a short time without larger quantities of water continuing to flow.

According to a further embodiment of the invention a part of the trunnion ring mantle is incorporated into the cooling system. For this purpose, pipe sections such as half-pipes, angle sections and U-sections can be used. These can be intimately connected to the trunnion ring mantle by means of single welded seams.

In a further embodiment of the invention, a cooling block is used, which consists, for example, of aluminum and has interconnected bores. This block is pressed by a contact mass against the inner surface of the trunnion ring. In still another embodiment the coolant conduits are divided into separate cooling circuits and these be connected to a control device. This permits energy consumption to be reduced even further, because cooling can be initiated by the control device in a maimer adjusted to the load.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE INVENTION

FIG. 1 is a section through the converter trunnion ring pursuant to the present invention;

FIGS. 2*1*, 2*b*, 2*c*, 2*d* and 2*e* illustrate embodiments of the pipe coil;

FIG. 3 shows a measurement and control device of the cooling water conduit; and FIG. 4 is a section of FIG. 3.

DETAILED DESCRIPTION OF THE PREFERRED EMBODIMENT

Figure 1:
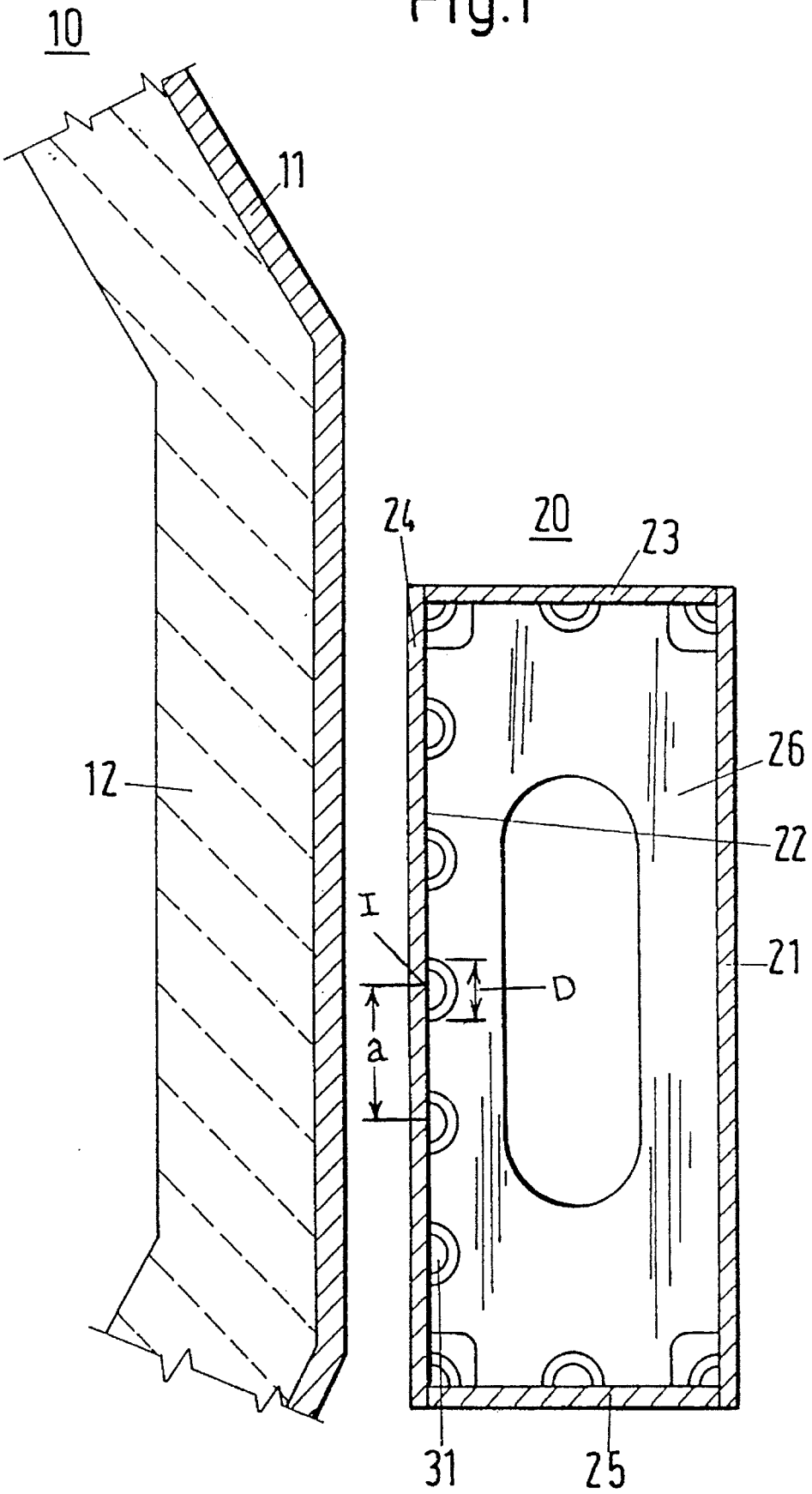

FIG. 1 shows, in section, a converter 10 with a converter mantle 11 and a refractory lining 12. A converter trunnion ring 20 is arranged at a distance from the converter 10. The trunnion ring 20 has a mantle 21 to which partitions 26 are connected. The mantle 21 includes an inner side member 24, an upper member 23 and a lower member 25. A pipe coil 31 is provided on the inner surface 22 of the upper member 23, the lower member 25, and the inner side member 24 of the trunnion ring mantle 21 facing the converter 10.

Figure 2A:
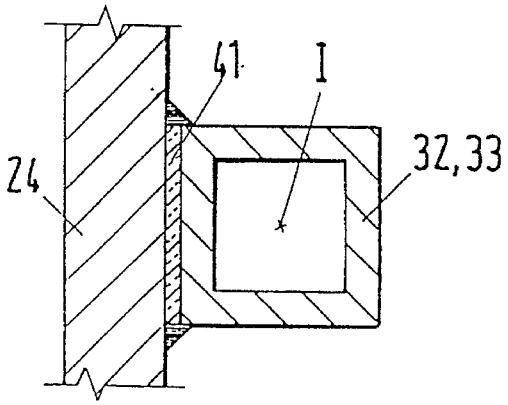

FIGS. 2*a–e* show various design forms of the pipe coil 31, designed as the pipe section 32 and located, in the examples, on the inner side member 24 of the trunnion ring mantle 21. In FIG. 2*a*, the pipe section 32 has a square cross-section 33, which is welded onto the inner side member 24 and is connected to the latter, with respect to heat flow, via a contact mass 41, such as a paste having a high conductivity.

Figure 2B:
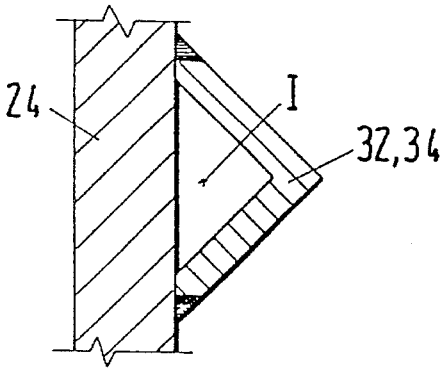
Figure 2C:
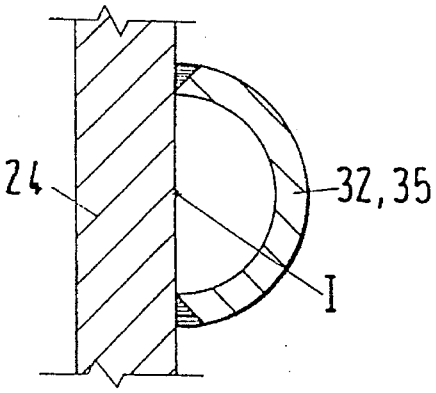
Figure 2D:
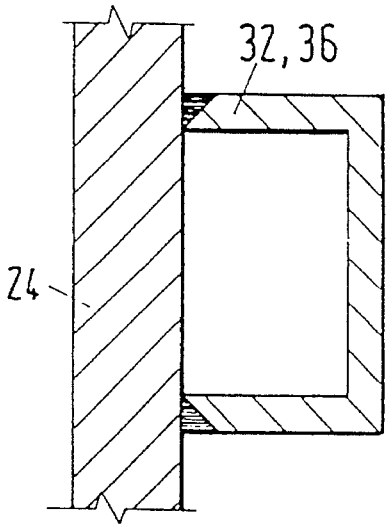

In FIGS. 2*b*, 2*c* and 2*d*, an angle section 34, a half-pipe 35 and a U-section 36 are respectively shown, whereby the respective free ends of the sections are connected to the inner side 24 and form with the latter the pipe section 32. The center axis of the pipe section is indicated with the letter I. The portion of the inner surface 22 that forms part of the pipe cross-section is less than half the total inner surface of the pipe section 32.

Figure 2E:
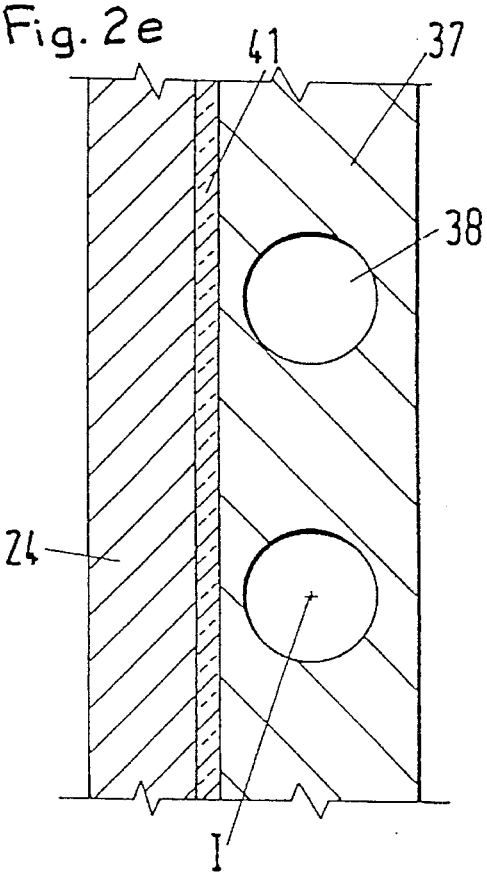

The example shown in FIG. 2*e* is an aluminum cooling block 37, provided with the bores 38. The block 37 is connected via the contact mass 41 to the inner side member 24 of the trunnion ring mantle 21.

FIG. 3 shows a longitudinal section through the upper member 23 and the lower member 25, as well as the partitions 26 of the trunnion ring 20. The meandering course of the pipe coil 31 can be seen in this Figure. Specifically, a coolant conduit 30 is shown with an essentially vertical flow direction cooling circuit K1 on the left side and an essentially horizontal cooling circuit K2 on the right side of the coolant conduit 30. The cooling circuits K1 and K2 are connected to a control loop 50 which includes control and regulating device 54, which has a safety valve 51, a pressure control device 52 and a temperature sensor 53. FIG. 4 is a section through the vertical cooling circuit K1 for comparison to the section through circuit K2 shown in FIG. 1.

The inner surface 22 of the trunnion ring 20 which forms the common wall of the pipe coil 31 forms a portion of the cross-section of the pipe section 32 based upon the following relationship: UT<0.7 UR, where UT is the portion of the cross-section formed by the trunnion ring inner surface 22 and UR is the remaining portion of the pipe section 22.

The invention is not limited by the embodiments described above which are presented as examples only but can be modified in various ways within the scope of protection defined by the appended patent claims.

I claim:

1. A cooled converter trunnion ring arrangeable at a distance from a converter so as to encompass the converter, the trunnion ring comprising: a steel mantle having an inner side arrangeable to substantially face the converter, the inner side having an inner surface; and at least two pipe coils mounted on the inner surface of the inner side of the steel mantle in a meandering fashion so that a portion of the inner surface of the steel mantle forms part of the pipe coils, as seen in cross-section, and so as to permit a liquid coolant to flow through the pipe coils, the pipe coils being arranged so that adjacent pipe coils are separated by a distance that is at least twice a diameter of the pipe coils.

2. A cooled converter trunnion ring as defined in claim 1, wherein the portion of the inner surface of the steel mantle which forms the part of the pipe coil cross-section is less than half of the entire inner surface, a remaining portion of the pipe cross-section being one of an angle, a half-pipe and a U-section.

3. A cooled converter trunnion ring as defined in claim 1, wherein the portion of the inner surface of the mantle which forms part of the pipe coil forms a portion of the cross-section of the pipe coil based upon the relationship UT<0.7 UR, wherein UT is an amount of the cross-section formed by the inner surface and UR is a remaining portion of the cross-section.

4. A cooled converter trunnion ring as defined in claim 1, and further comprising a cooling block having bores therein which form the pipe coil, and a contact mass provided so as to connect the cooling block to the inner surface of the mantle in a total area fashion.

5. A cooled converter trunnion ring as defined in claim 4, wherein the cooling block is made of aluminum.

6. A cooled converter trunnion ring as defined in claim 4, wherein the contact mass is a paste having high conductivity.

7. A cooled converter trunnion ring as defined in claim 1, wherein the pipe coil forms a coolant conduit which is divided into separate cooling circuits.

8. A cooled converter trunnion ring as defined in claim 7, and further comprising a control loop which includes safety valves, pressure control devices and temperature sensors operatively connected to the separate cooling circuit to monitor and control coolant quantity in the cooling circuits.

9. A cooled converter trunnion ring as defined in claim 1, and further comprising coolant supply means for supplying coolant to the pipe coil.

* * * * *